United States Patent [19]

Nishiba

[11] 4,132,154

[45] Jan. 2, 1979

[54] RADIAL PISTON TYPE HYDRAULIC PUMP-MOTOR

[75] Inventor: Kenzo Nishiba, Gifu, Japan

[73] Assignee: Teijin Seiki Company Limited, Osaka, Japan

[21] Appl. No.: 751,322

[22] Filed: Dec. 16, 1976

[30] Foreign Application Priority Data

Dec. 27, 1975 [JP] Japan ..... 50-157532

[51] Int. Cl.[2] ..... F01B 13/06

[52] U.S. Cl. ..... 91/491; 91/503

[58] Field of Search ..... 308/196; 91/491, 492, 91/486, 487, 501

[56] References Cited

U.S. PATENT DOCUMENTS

| | | | |
|---|---|---|---|
| 1,492,672 | 5/1924 | Brunner | 308/196 |
| 2,712,794 | 7/1955 | Humphreys | 91/492 |
| 2,917,290 | 12/1959 | Peterson | 74/87 |
| 3,046,950 | 7/1962 | Smith | 91/491 |
| 3,090,361 | 5/1963 | Orshansky | 91/486 |
| 3,151,529 | 10/1964 | Leath | 91/491 |
| 3,156,010 | 11/1964 | Johnson et al. | 91/501 |
| 3,447,394 | 6/1969 | Wagner | 308/196 |
| 3,584,542 | 6/1971 | Denker | 91/498 |
| 3,796,136 | 3/1974 | Ogunl | 91/491 |
| 3,895,565 | 7/1975 | Schottler | 91/492 |

FOREIGN PATENT DOCUMENTS

| | | | |
|---|---|---|---|
| 2601232 | 7/1976 | Fed. Rep. of Germany | 91/491 |
| 2552677 | 12/1976 | Fed. Rep. of Germany | 91/491 |

*Primary Examiner*—William L. Freeh

*Attorney, Agent, or Firm*—Cushman, Darby & Cushman

[57] ABSTRACT

A radial piston type hydraulic pump-motor comprises a cylinder block formed with a plurality of radial cylinders circumferentially equally spaced and each opened at its radially outer end; a plurality of piston assemblies each radially slidably accommodated in each of the radial cylinders of the cylinder block to provide a cylinder chamber defined by the radial cylinder and the piston assembly; a plurality of inlet-outlet passages formed in the cylinder block, each having one end opened at said cylinder chamber and the other end opened exteriorly of the cylinder block; a housing accommodating therein the cylinder block and the piston assemblies and having a radially inner face held in contact with the radially outer ends of the piston assemblies, the improvement is characterized in that the radially outer end of the piston assemblies is in contact with the radially inner face of the housing at its axially spaced two points.

3 Claims, 16 Drawing Figures

RADIAL PISTON TYPE HYDRAULIC PUMP-MOTOR

The present invention relates to a radial piston type hydraulic pump-motor and more particularly to a radial piston type hydraulic pump-motor which is provided with distributing valves to introduce and discharge a liquid into and from a number of radial cylinders.

In the conventional hydraulic pump-motor, in order to decrease a load exerted upon a cam or inner surface of a ring casing to be in contact with radially outer ends of pistons, there has been proposed a method in which the inner surface of the ring casing is improved in shape for decreasing circumferential local and whole loads on the ring casing. However, there has been a limit for improvement of the inner surface of the ring casing in a circumferential direction, which makes it impossible to decrease such loads.

It is a primary object of the present invention to provide a radial piston type hydraulic pump-motor which serves to sufficiently decrease a load exerted upon the inner surface of the ring casing as well as provides a long longevity with the ring casing.

It is another object of the present invention to provide a radial piston type hydraulic pump-motor which is not only inexpensive but also reduced in its total weight and size.

The above objects will be attained by a radial piston type hydraulic pump-motor embodying the present invention which comprises: a cylinder block formed with a plurality of radial cylinders circumferentially equally spaced and each opened at its radially outer end; a plurality of piston assemblies each radially slidably accommodated in each of the radial cylinders of the cylinder block to provide a cylinder chamber defined by the radial cylinder and the piston assembly; a plurality of inlet-outlet passages formed in the cylinder block, each having one end opened at the cylinder chamber and the other end opened at exteriorly of the cylinder block; a housing accommodating therein the cylinder block and the piston assemblies and having a radially inner face held in contact with the radially outer ends of the piston assemblies: the improvement characterized in that the radially outer end of each of the piston assemblies is in contact with the radially inner face of said housing at its axially spaced two points.

According to the other aspect of the present invention, each of the piston assemblies may include a piston radially slidably accommodated in each of the radial cylinders and a spherical member rotatably retained on the radially outer end of the piston in contact with the radially inner face of the housing at is axially spaced two points. Each of the piston assemblies may also include a piston radially slidably accommodated in each of the radial cylinders and formed at its radially outer end with a domed head contacting with the radially inner face of the housing at its axially spaced two points.

The above and other objects, features and advantages of the present invention will become clear from the following particular description of the invention and the appended claims, taken in conjunction with the accompanying drawings which show by way of example a preferred embodiment of the present invention.

Figure 1:
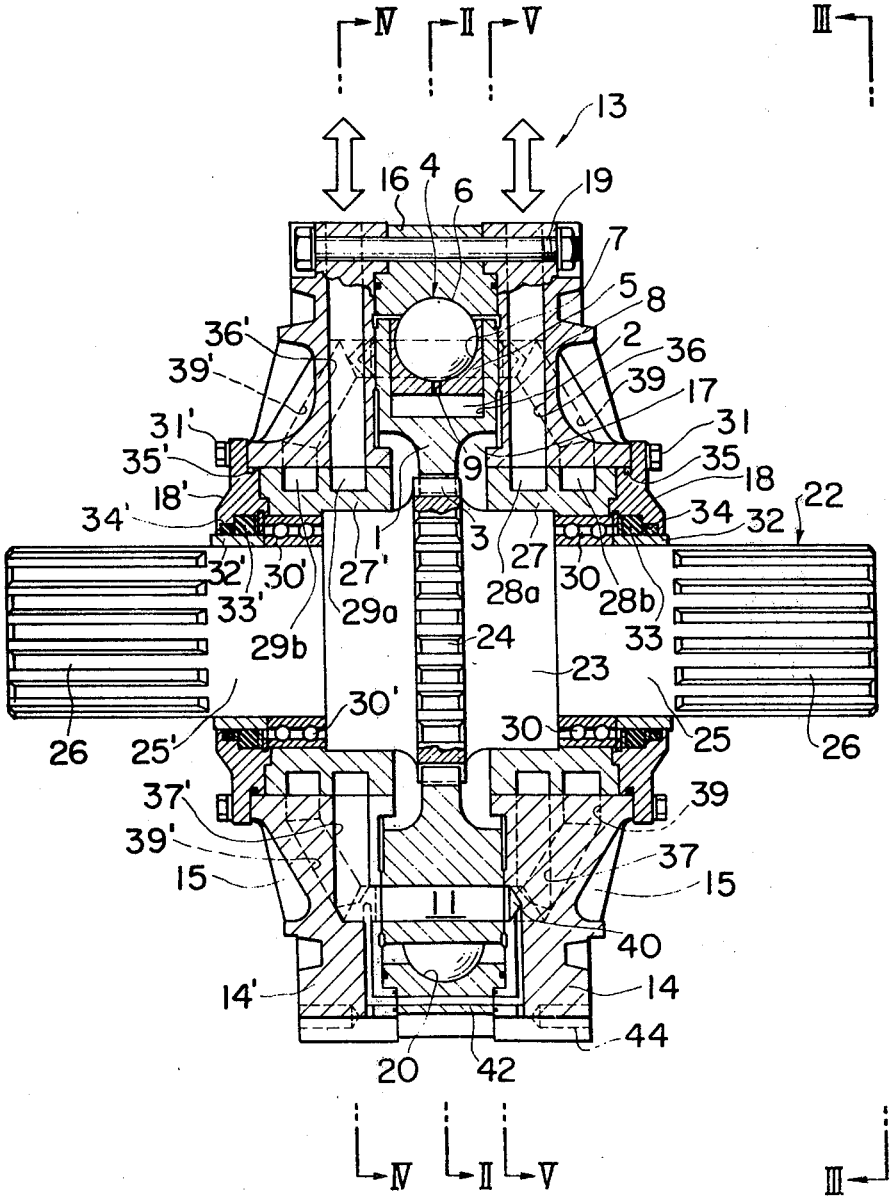
FIG. 1 is an axial cross-sectional view of a first embodiment of a radial piston type hydraulic pump-motor in accordance with the present invention.
Figure 2:
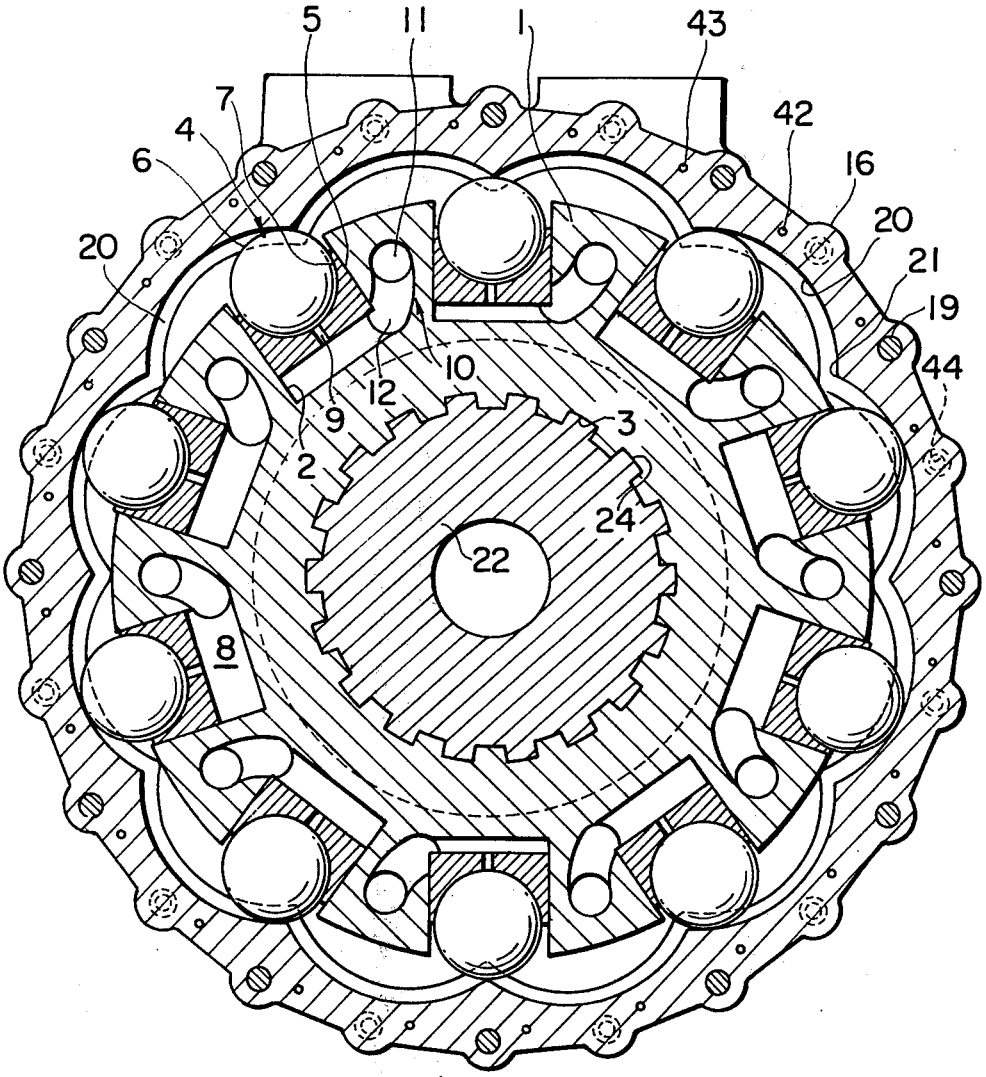
FIG. 2 is a cross-sectional view as seen from the lines II—II of FIG. 1.
Figure 3:
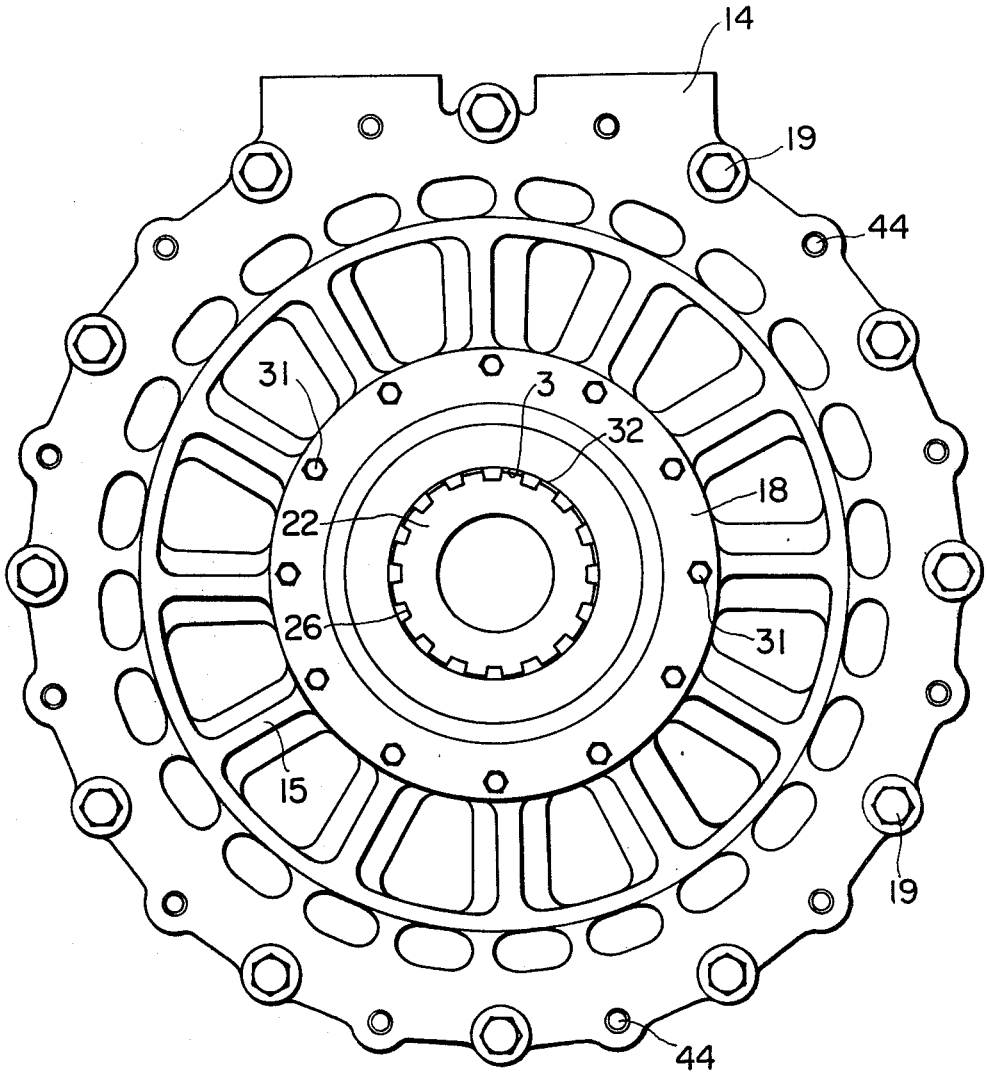
FIG. 3 is a side view as seen from the lines III—III of FIG. 1.
Figure 4:
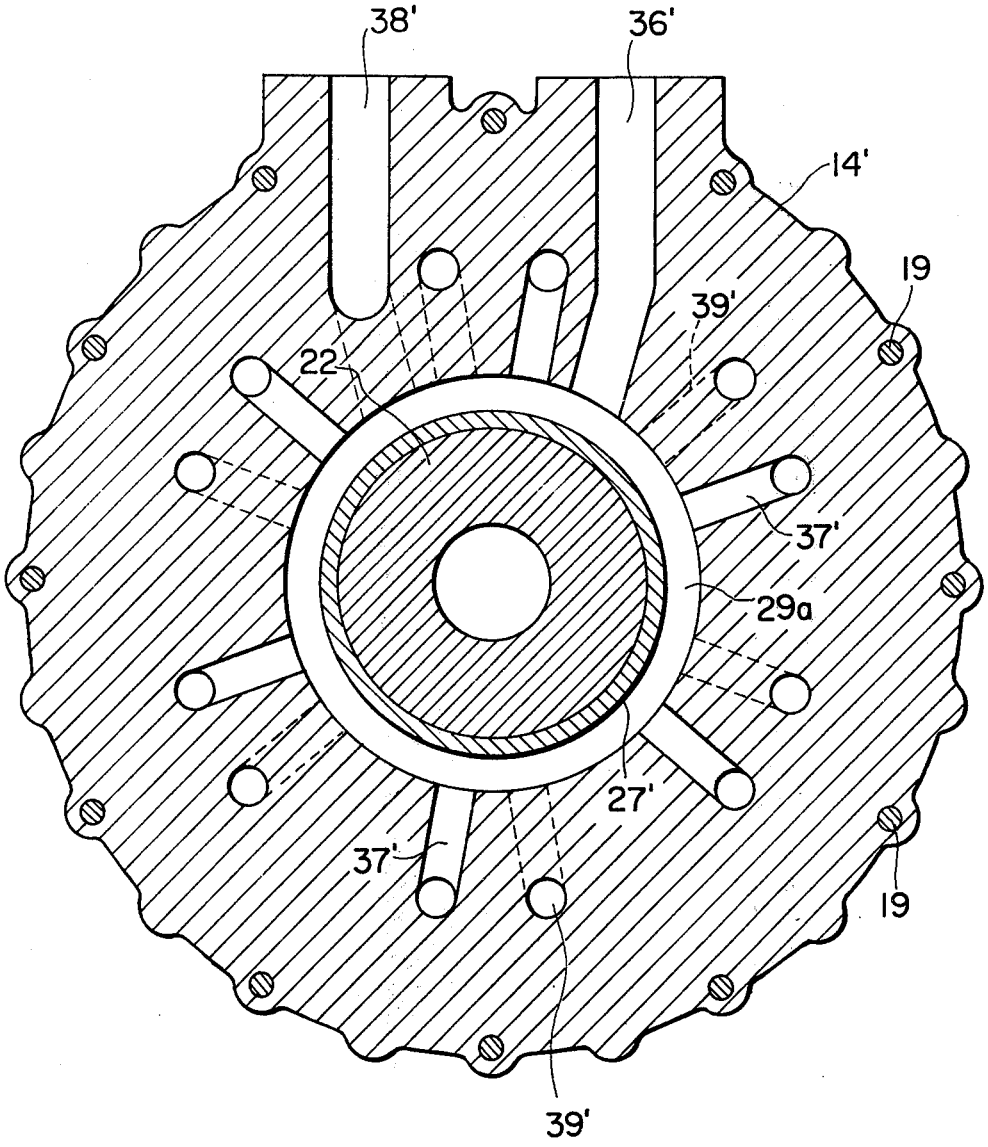
FIG. 4 is a cross-sectional view as seen from the lines IV—IV of FIG. 1.
Figure 5:
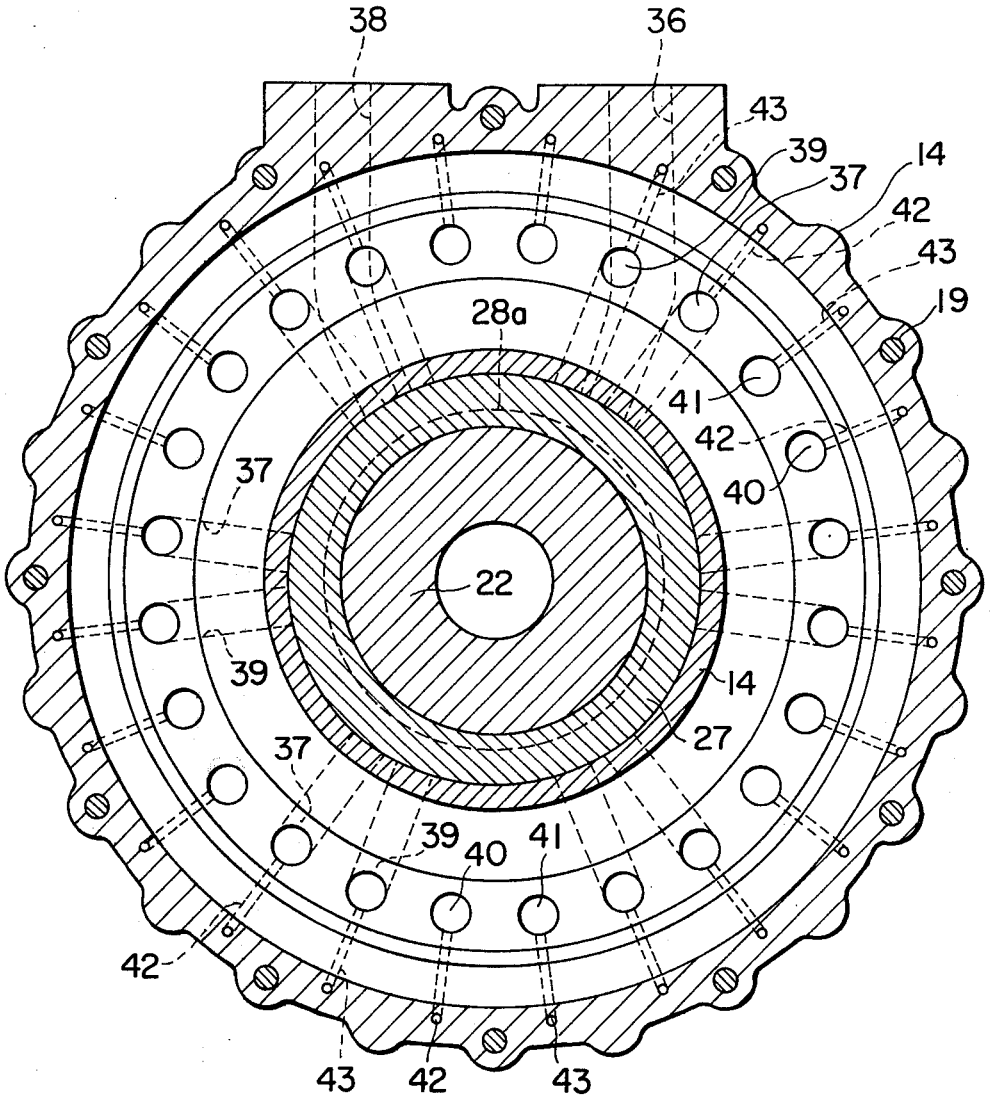
FIG. 5 is a cross-sectional view as seen from the lines V—V of FIG. 1.
Figure 6:
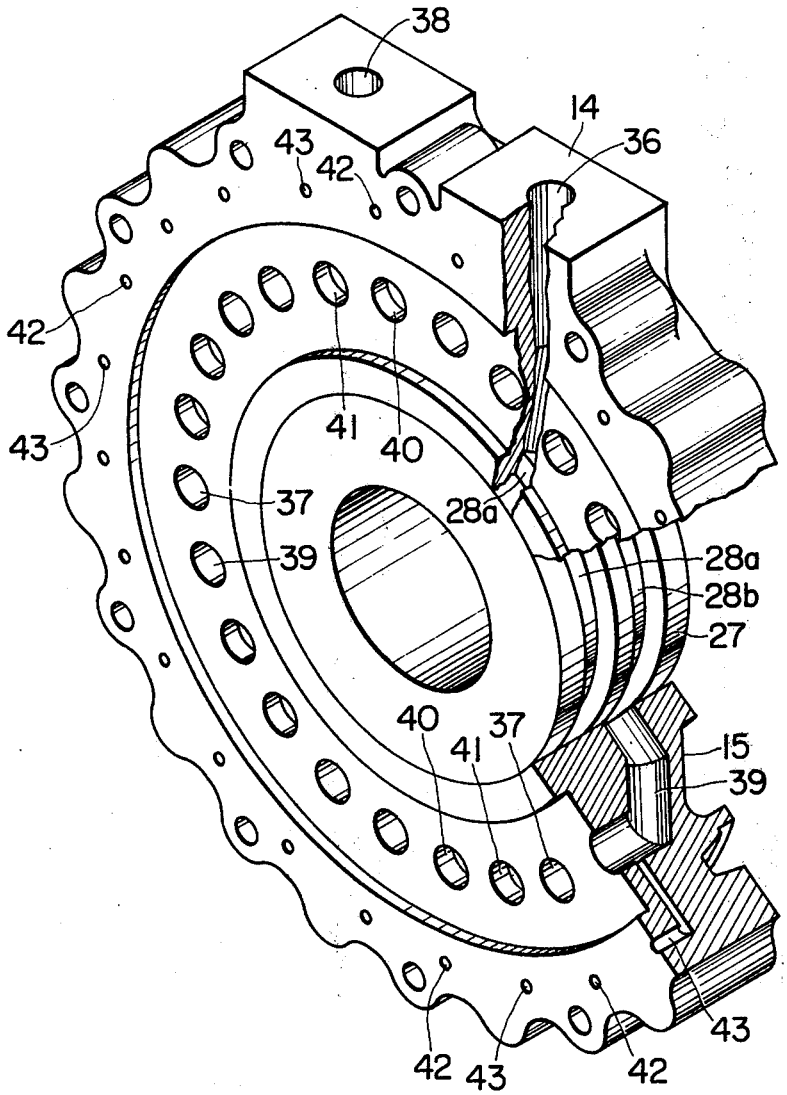
FIG. 6 is schematic view, partly broken away, of a disc casing to be assembled in the first embodiment of the radial piston type hydraulic pump-motor in accordance with the present invention.

Referring now to the drawings and in particular to FIGS. 1 and 2, there is shown a first embodiment of a radial piston type hydraulic pump-motor in accordance with the present invention which comprises a cylinder block 1 formed with a plurality of radial cylinders 2 which are circumferentially equally spaced and each of which is opened at its radially outer end. The cylinder block 1 is formed at its inner periphery with splines 3 axially extending. A plurality of piston assemblies, only one of which is generally indicated at 4 in FIG. 1, each include a piston 5 radially slidably accommodated in each of the radial cylinders 2 and a spherical member 6 rotatably retained on a curved recess 7 formed at radially outer end of the piston 5. The accommodation of the piston 5 within the radial cylinder 2 provides a cylinder chamber 8 defined by the radial cylinder 2 and the piston 5. In order to allow the spherical member 6 to freely rotate, a radial bore 9 is formed in the piston 5 to communicate the curved recess 7 with the cylinder chamber 8 so that a pressure oil is fed to a gap defined between the recess 7 and the spherical member 6 through the radial bore 9 from the cylinder chamber 8. The reference numeral 10 generally designates a plurality of inlet-outlet passages formed in the cylinder block 1 in equally spaced relation with each other along the circumferential direction of the cylinder block 1. Each of the inlet-outlet passages 10 includes a horizontal bore 11 horizontally extending throughout and opened at the side faces of the cylinder block 1 and a cylinder bore 12 having one end opened at the cylinder chamber 8 defined when the piston 5 is moved to the radially inward stroke end and the other end communicated with the longitudinally intermediate portion of the horizontal bore 11. According to the present invention the ends of the horizontal bore 11 are required to be positioned radially outwardly of the one end of the cylinder bore 12.

With reference particularly to FIG. 1 and FIGS. 3 to 6, a housing generally denoted at 13 comprises a pair of spaced and facing disc casings 14 and 14' each of which is reinforced by a number of radial rims 15 circumferentially equi-angulary and integrally formed at the axially outer face, a ring casing 16 interposed between the disc casings 14 and 14' to define a chamber 17 for accommodating the cylinder block 1 therein, and a pair of covers 18 and 18' respectively coupled with the axially outer faces of the disc casings 14 and 14'. A number of bolts and nuts 19 fix the disc casings 14 and 14' and the ring casing 16 at their radially outer end portions circumferentially equally spaced. The ring casing 16 has an inner face formed with a multiplicity of curved recesses 20 and a multiplicity of ridges 21 each separated by the adjacent two curved recesses 20, the curved recesses 20 and the ridges 21 being held in contact with the spherical members 6 of the piston assemblies 4.

Figure 12:
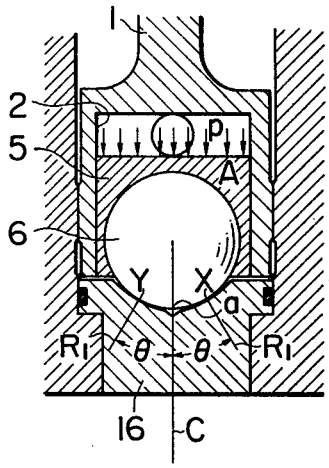
FIG. 12 is an enlarged axially cross-sectional view of a portion including the ring casing and the piston.
Figure 13:
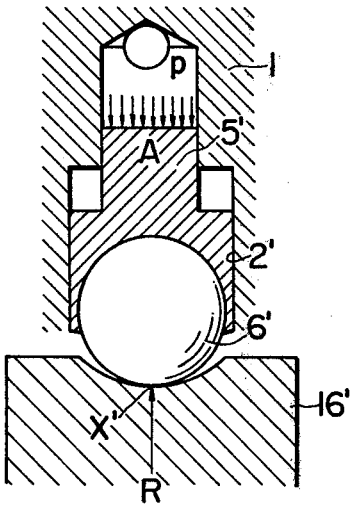
FIG. 13 PRIOR ART
FIG. 13 is a similar view to FIG. 12 but showing a prior art.

The relationship between the spherical member 6 and the ring casing 16 is required to have such a condition that the radially outer end of the spherical member 6 is contact with the radially inner face of the ring casing 16 at its axially spaced two points X and Y as shown in FIG. 12. In the conventional relationship between the spherical member 6' and the ring casing 16' was maintained in such a condition that the radially outer end of the spherical member 6' was in contact with the radially inner face of the ring casing 16' at only one point X' since each of the curved recesses and the ridges was formed having an axially cross-sectional curvature somewhat larger than that of the spherical member 6' as shown in FIG. 13. If a hydraulic pressure is now represented by the legend p, an area of the radially inner face of the piston 5' to be exerted with the hydraulic pressure p is represented by the legent A, and a reaction force of the ring casing 16' is represented by the legent R, the equation will be given $PA=R$. In contrast, the two points contact by the spherical member 6 causes each of the two points X and Y to be decreased in its reaction force at a rate of $\frac{1}{2}\cos\theta$ with the same force PA, exerted upon the ring casing 16, to the conventional case. If each of the angle $\theta$ is 30 degrees, the reaction force of each of the two points X and Y is decreased at a rate of the value 0.578 in comparison with the conventional one. The reduced value not only enables the hydraulic pressure to be enhanced but also makes long the longevity of the hydraulic pump-motor. The angle to each of the contacting points X and Y from the center line passing through the centers of the spherical member 6 and the ring casing 16 advantageously ranges from zero degree to 60 degrees. Further, it is prererable that the angle be sufficiently small to prevent a resultant stress peak, added by the stresses exerted upon the two contacting points X and Y, from being generated at the central point passing through the centers of the spherical member 6 and the ring casing 16.

Referring again to FIGS. 1 and 2, a shaft generally designated at 22 comprises a large diameter portion 23 formed with axially extending splines 24 to be in meshing engagement with the splines 3 of the cylinder block 1 and small diameter portions 25 and 25' integrally formed with the both axial ends of the large diameter portion 23 and each having axially extending splines 26 to be meshed with other coupling members not shown. A pair of central rings 27 and 27' are respectively positioned radially inwardly of the respective disc casings 14 and 14' and securely connected with the respective disc casings 14 and 14'. Each of the central rings 27 and 27' are rotatably received at its axially inner half on the large diameter portion 23, and the central ring 27 has two juxtaposed circumferential grooves 28*a* and 28*b* formed in the outer peripheral wall thereof while the central ring 27' also having two juxtaposed circumferential grooves 29*a* and 29*b* formed in the outer peripheral wall thereof. A pair of ball bearings 30 and 30' are disposed axially outwardly of the large diameter portion 23 and between the axially outer halves of the central rings 27, 27' and the small diameter portions 25, 25', respectively, of the shaft 22. The covers 18 and 18' are respectively securely coupled with the axially outer faces of the disc casings 14 and 14' by means of a number of bolts 31 and 31' to cover the central rings 27 and 27'. Rings 32 and 32' are received on the small diameter portions 25 and 25', respectively, of the shaft 22 to be in opposing relation with the inner faces of the covers 18 and 18', respectively. An oil seal 33 is interposed between the cover 18 and the ring 32, and a dust seal 34 is interposed between the cover 18 and the ring 32 at a position axially outwardly of the oil seal 33. Similarly, another oil seal 33' is interposed between the cover 18' and the ring 32', and another dust seal 34' is interposed between the cover 18' and the ring 32' at a position axially outwardly of the oil seal 33'. An O-ring 35 is received in a groove, which is formed in the inner face of the cover 18, to prevent leakage of the pressure oil, while another O-ring 35' is also received in another groove, which is also formed in the inner face of the cover 18', to prevent leakage of the pressure oil. A main introducing passage 36 is formed radially in the disc casing 14 and has one end opened at the radially outer end of the disc casing 14 and the other end communicated with the circumferential groove 28*a* of the central ring 27. A plurality of branch introducing passages 37 are formed radially in the disc casing 14 and each has one end communicated with the circumferential groove 28*a* of the central ring 27 and the other end opened in circumferential alignment with the ends of the horizontal bores 11 of the inlet-outlet passages 10 to be communicatable therewith. On the other hand, another main introducing passage 36' is formed radially in the disc casing 14' and has one end opened at the radially outer end of the disc casing 14' and the other end communicated with the circumferential groove 29*a* of the central ring 27'. A plurality of branch introducing passages 37' are formed radially in the disc casing 14' and each has one end communicated with the circumferential groove 29*a* of the central ring 27' and the other end opened in circumferential alignment with the ends of the horizontal bores 11 of the inlet-outlet passages 10 to be communicatable therewith. The main introducing passage 36, the circumferential groove 28*a*, and the branch introducing passages 37 constitute as a whole a introducing passage, while the main introducing passage 36', the circumferential groove 29*a* and the branch introducing passages 37' also constitute as a whole another introducing passage, the both introducing passages being however not indicated by the reference numerals for avoiding complexity in the drawings. A main discharge passage 38 is formed radially in the disc casing 14 and has one end opened at the radially outer end of the disc casing 14 and the other end communicated with the circumferential groove 28*b* of the central ring 27. A plurality of branch discharge passages 39 are formed radially in the disc casing 14 and each has one end communicated with the circumferential groove 28*b* of the central ring 27 and the other end opened in circumferential alignment with the ends of the horizontal bores 11 of the inlet-outlet passages 10 to be communicatable therewith. On the other hand, another main discharge passage 38' is formed radially in the disc casing 14' and has one end opened at the radially outer end of the disc casing 14' and the other end communicated with the circumferential groove 29*b* of the central ring 27'. A plurality of branch discharge passages 39' are formed radially in the disc casing 14' and each has one end communicated with the circumferential groove 29*b* of the central ring 27' and the other end opened in circumferential alignment with the ends of the horizontal bores 11 of the inlet-outlet passages 10 to be communicatable therewith. The main discharge passage 38, the circumferential groove 28*b*, and the branch introducing passages 39 constitute as a whole a discharge passage, while the main discharge passages 38', the circumferential groove 29*b* and the branch introducing passage 39' also constitute as a whole another discharge passage, the both discharge passages being however not indicated by the reference numerals for avoiding complexity in the drawings. A plurality of reservoir recesses 40 and 41 are formed in each of the disc casings 14 and 14' in such a manner that the reservoir recess 40 is in opposing relation with each of the other ends of the branch introducing passages 37 and 37' and that the reservoir recess 41 is in opposing relation with each of the other ends of the branch discharge passages 39 and 39'. A plurality of by-pass passages 42 and 43 are formed in the disc casings 14, 14' and the ring casing 16 in such a manner that the by-pass passage 42 has one end communicated with each of the other ends of the branch introducing passages 37 and 37' and the other end opened at the reservoir recess 40 opposing to each of the other ends of the branch introducing passages 37 and 37' and that the by-pass passage 43 has one end communicated with each of the other ends of the branch discharge passages 39 and 39' and the other end opened at the reservoir recess 41 opposing to each of the other ends of the branch discharge passages 39 and 39'. Provision of such by-pass passages 42 and 43 makes it possible to balance hydraulic pressures horizontally exerted upon the both side faces of the cylinder block 1 as well as to provide a liquid film between the opposing slide surfaces of the cylinder block 1 and the disc casings 14 and 14'. A plurality of coupling bores 44 are formed in the axially outer face of each of the disc casings 14 and 14' to be interposed between every two adjacent bolts and nuts 19, which enables other equipment to be engaged with the coupling bores 44 for preventing rotation of the disc casings 14, 14', the ring casing 16 and covers 18, 18'.

The operation of the radial piston type hydraulic pump-motor thus constructed and arranged will be now described hereinlater in the case that the pump-motor is utilized as a hydraulic motor.

When a high pressure oil is introduced into the main introducing passages 36 and 36' from a suitable pressure oil source not shown, the pressure oil is entered into the circumferential grooves 28*a* and 29*a* and distributed therealong. The pressure oil is then supplied to the branch introducing passages 37 and 37' and subsequently admitted into the horizontal bores 11 which are under communication with the branch introducing passages 37 and 37'. The pressure is finally entered into the cylinder chambers 8 through the cylinder bores 12 so that the pistons 5 are radially outwardly moved to urge the spherical members 6 against the downwardly curved recesses 7. At this time, the cylinder block 1 is rotated and its rotational torque is transmitted to the shaft 22 through the splines 3 and 24. As the cylinder block 1 is further rotated and the spherical members 6 commerce to urge against the upwardly curved recesses 7, the pistons 5 are forced to be radially inwardly moved so that the pressure oil is discharged from the cylinder chambers 8 to the horizontal bores 11 through the cylinder bores 12. The pressure oil within the horizontal bore 11 is entered into the circumferential grooves 28*b* and 29*b* through the branch discharge passages 39 and 39' and thereafter discharged exteriorly through the main discharge passages 38 and 38'. During rotation of the cylinder block 1, hydraulic pressures horizontally exerted upon the both side faces of the cylinder block 1 are maintained balanced and a liquid film is provided between the opposing slide surfaces of the disc casings 14, 14' and the cylinder block 1, thereby casing a smooth rotation to the cylinder block 1.

According to the present invention, there may be embodied a second embodiment which will be described hereinlater.

Figure 7:
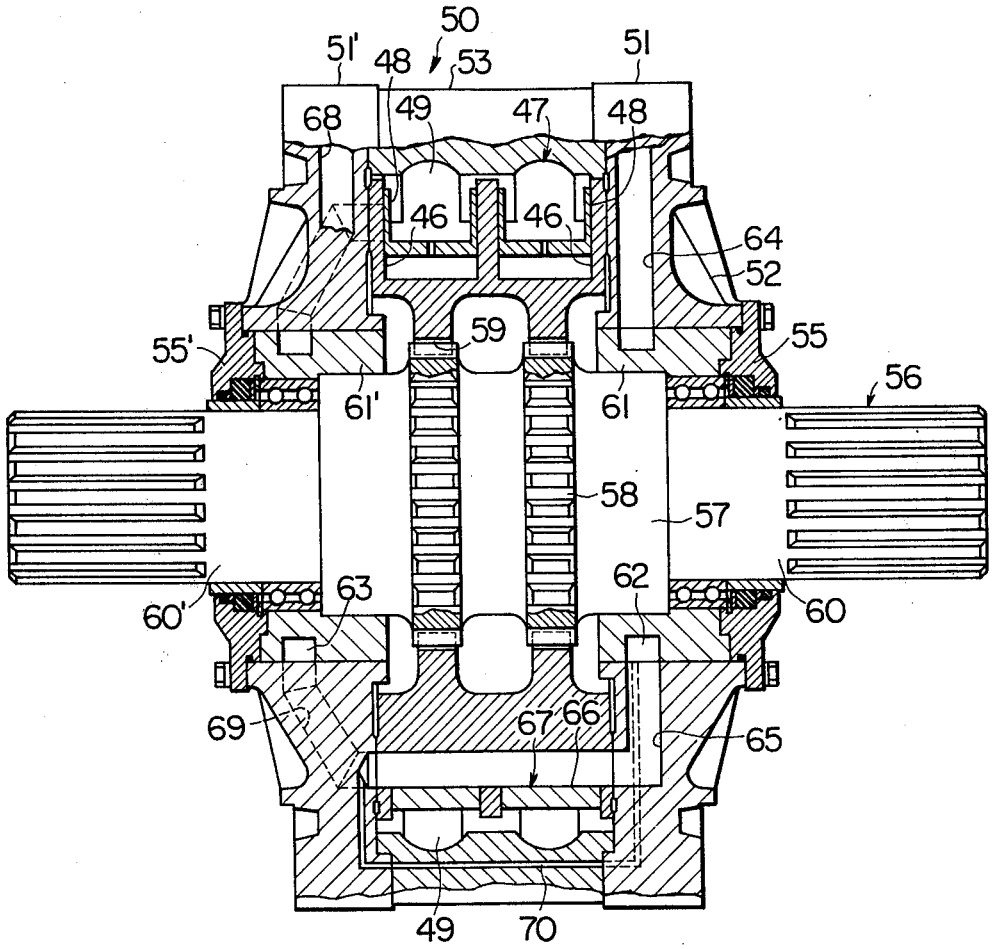
FIG. 7 is an axial fragmentary cross-sectional view similar to FIG. 1 but showing a second embodiment of the radial piston type hydraulic pump-motor in accordance with the present invention.

In FIG. 7, a cylinder block 45 is formed with two axially spaced series of radial cylinders 46 in such a way that the radial cylinders 46 of each series are circumferentially equally spaced, each radial cylinder 46 being opened at its radially outer end. Each of a plurality of piston assemblies generally designated at 47 is radially slidably accommodate in each of the radial cylinders 46 of the cylinder block 45. Each of the piston assemblies 47 includes a piston 48 radially slidably accommodated in each of the radial cylinders 46 and a dome-headed member 49 retained within the piston 48 to have a rotational axis in perpendicular relation with the movement of the piston 48. A housing generally denoted at 50 comprises a pair of spaced and facing disc casings 51 and 51' each of which is reinforced by a number of radial rims 52 circumferentially equi-angulary and integrally formed at the axially outer face, a ring casing 53 interposed between the disc casings 51 and 51' to define a chamber 54 for accommodating the cylinder block 45 therein, and a pair of covers 55 and 55' respectively coupled with the axially outer faces of the disc casings 51 and 51'. The disc casings 51 and 51' and the ring casing 53 are bolted at their radially outer end portions circumferentially equally spaced. The dome-headed members 49 are adapted to be in contact with the radially inner face of the ring casings 53 at its axially spaced two points. A shaft generally designated at 56 comprises a large diameter portion 57 formed with two axially extending splines 58 to be in meshing engagement with splines 59 formed at the inner periphery of the cylinder block 45 and small diameter portions 60 and 60' integrally formed with the both axial ends of the large diameter portion 57. A pair of central rints 61 and 61' is positioned radially inwardly of the respective disc casings 51 and 51' and securely connected with the respective disc casings 51 and 51'. Each of the central rings 61 and 61' are rotatably received at its axially inner half on the large diameter portion 57, and the central ring 61 has a circumferential groove 62 formed in the outer peripheral wall thereof while the central ring 61' also having a circumferential groove 63 formed in the outer peripheral wall thereof. A main introducing passage 64 is formed radially in the disc casing 51 and has one end opened at the radially outer end of the disc casing 51 and the other end communicated with the circumferential groove 62 of the central ring 61. A plurality of branch introducing passages 65 are formed radially in the disc casing 51 and each has one end communicated with the circumferential groove 62 of the central ring 61 and the other end opened in circumferential alignment with the one ends of horizontal bores 66 of inlet-outlet passages 67 to be communicatable therewith. The horizontal bores 66 of the inlet-outlet passages 67 are constructed substantially identical to the first embodiment which has been described above. A main discharge passage 68 is formed radially in disc casing 51' and has one end opened at the radially outer end of the disc casing 51' and the other end communicated with the circumferential groove 63 of the central ring 61'. A plurality of branch discharge passages 69 are formed radially in the disc casing 51' and each has one end communicated with the circumferential groove 63 of the central ring 61' and the other end opened in circumferential alignment with the other ends of the horizontal bores 66 of the inlet-outlet passage 67 to be communicatable therewith. The main introducing passages 64, the circumferential groove 62, and the branch introducing passages 65 constitute as a whole an introducing passage, while the main discharge passage 68, the circumferential groove 63 and the branch discharge passages 69 also constitute as a whole a discharge passage, the introducing and discharge passages however not having the reference numerals for avoiding complexity in the drawings.

The other constitutional elements of the second embodiment are substantially the same to those of the first embodiment with the exception that the by-passage 70 has one end extended to the circumferential groove 62 or 63 for the same purpose to the first embodiment. For avoiding tedious repetition of the particular description of the other constitutional elements of the second embodiment, there will be not described hereinlater thereabout.

According to the present invention, there may be embodied a third embodiment which will be described hereinafter.

Figure 8:
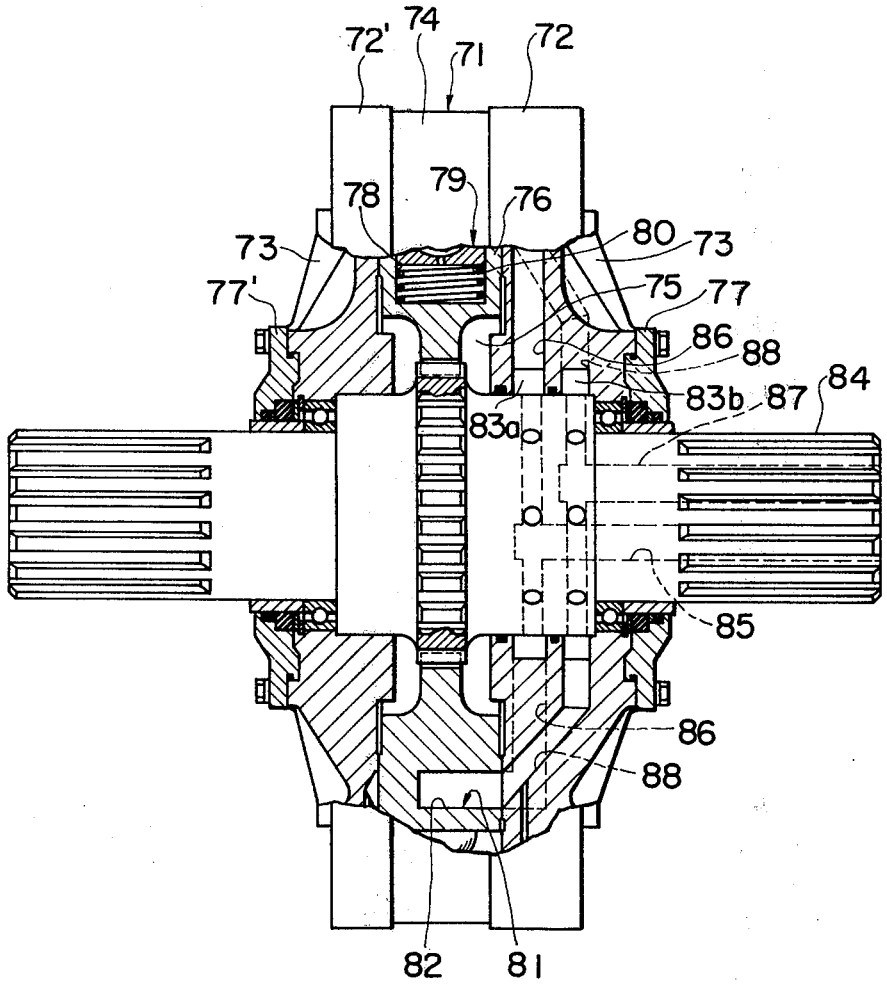
FIG. 8 is an axial fragmentary cross-sectional view similar to FIG. 7 but showing a third embodiment of the radial piston type hydraulic pump-motor in accordance with the present invention.

As shown in FIG. 8, a housing generally designated at 71 comprises a pair of spaced and facing disc casings 72 and 72' each of which is reinforced by a number of radial rims 73 circumferentially equi-angularly and integrally formed at the axially outer face, a ring casing 74 interposed between the disc casings 72 and 72' to define a chamber 75 for accommodating the cylinder black 76 therein, and a pair of covers 77 and 77' respectively coupled with the axially outer faces of the disc casings 72 and 72'. The cylinder block 76 has a plurality of radial cylinders 78, opened at its radially outer end, each of which is adapted to slidably accommodate a piston assembly 79 and a compression coil spring 80 accommodated between the radially inner face of the piston assembly 79 and the bottom surface of the radial cylinder 78 to normally urge the piston assembly 79 radially outwardly. A plurality of inlet-outlet passage 81 each includes a horizontal bore 82 horizontally extending and having one end opened at the side face of the cylinder block 76 and the other end adapted to be closed, and a cylinder bore not shown but having both ends communicated with the horizontal bore 82 and the cylinder chamber in a similar manner to the first embodiment. The disc casing 72 has two juxtaposed circumferential grooves **83*a* and 83*b* formed in the inner peripheral wall thereof. A shaft 84 has a main introducing passage 85 formed therein and having one end opened at the axial end of the shaft 84 and the other end branchedly communicated with the circumferential groove 83*a*. A plurality of branch introducing passages 86 are formed radially in the disc casing 72 and each has one end communicated with the circumferential groove 83*a* and the other end communicatable with the horizontal bores 82 of the inlet-outlet passages 81. The shaft 84 similarly has a main discharge passage 87 formed therein and having one end opened at the axial end of the shaft 84 and the other end branchedly communicated with the circumferential groove 83*b*. A plurality of branch discharge passages 88 are also formed radially in the disc casing 72 and each has one end communicated with the circumferential groove 83*b* and the other end communicatable with the horizontal bores 82 of the inlet-outlet passages 81**.

The other constitutional elements of the third embodiment are substantially the same to those of the first embodiment with the exception that the disc casing 72' has not therein any introducing and discharge passages which are however formed in the disc casing 14' of the first embodiment. Therefore, there will be not described hereinlater about the other constitutional elements of the third embodiment for avoiding tedious repetition of the particular description thereof.

Figure 9:
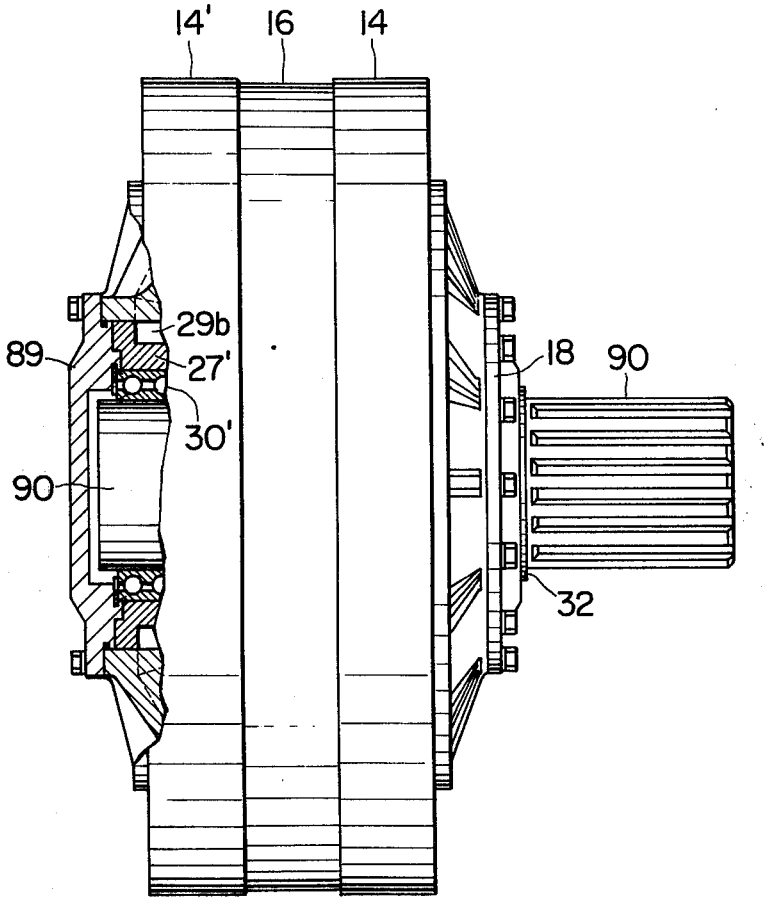
FIG. 9 is a side view, partly broken away, of a fourth embodiment of the radial piston type hydraulic pump-motor in accordance with the present invention, particularly showing a relationship between a cover casing and a shaft.

A fourth embodiment of the present invention is shown in FIG. 9 comprising a cover 89 formed into a substantially circular shape and a shaft 90 having one end extending opposingly to the inner face of the cover 89. The other constitutional elements of the fourth embodiment are substantially the same to those of the first embodiment with the exception that the oil seal 33' and the dust seal 32' illustrated in FIG. 1 are not provided in the fourth embodiment. Therefore, there will be not described hereinlater about the other constitutional elements of the fourth embodiment for avoiding tedious repetition of the particular description thereof.

Figure 10:
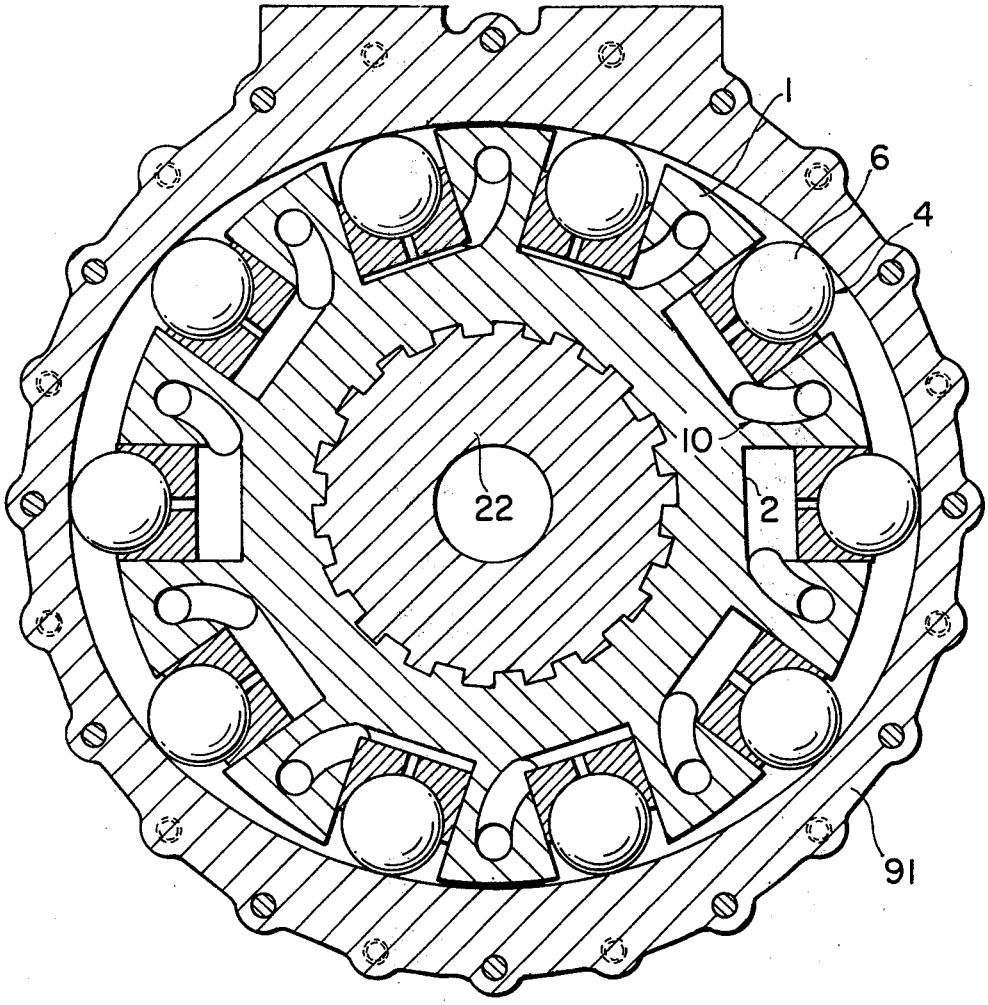
FIG. 10 is a cross-sectional view similar to FIG. 2 but showing a fifth embodiment of the radial piston type hydraulic pump-motor in accordance with the present invention in which a ring casing has an inner face formed into a substantial ellipse.
Figure 11:
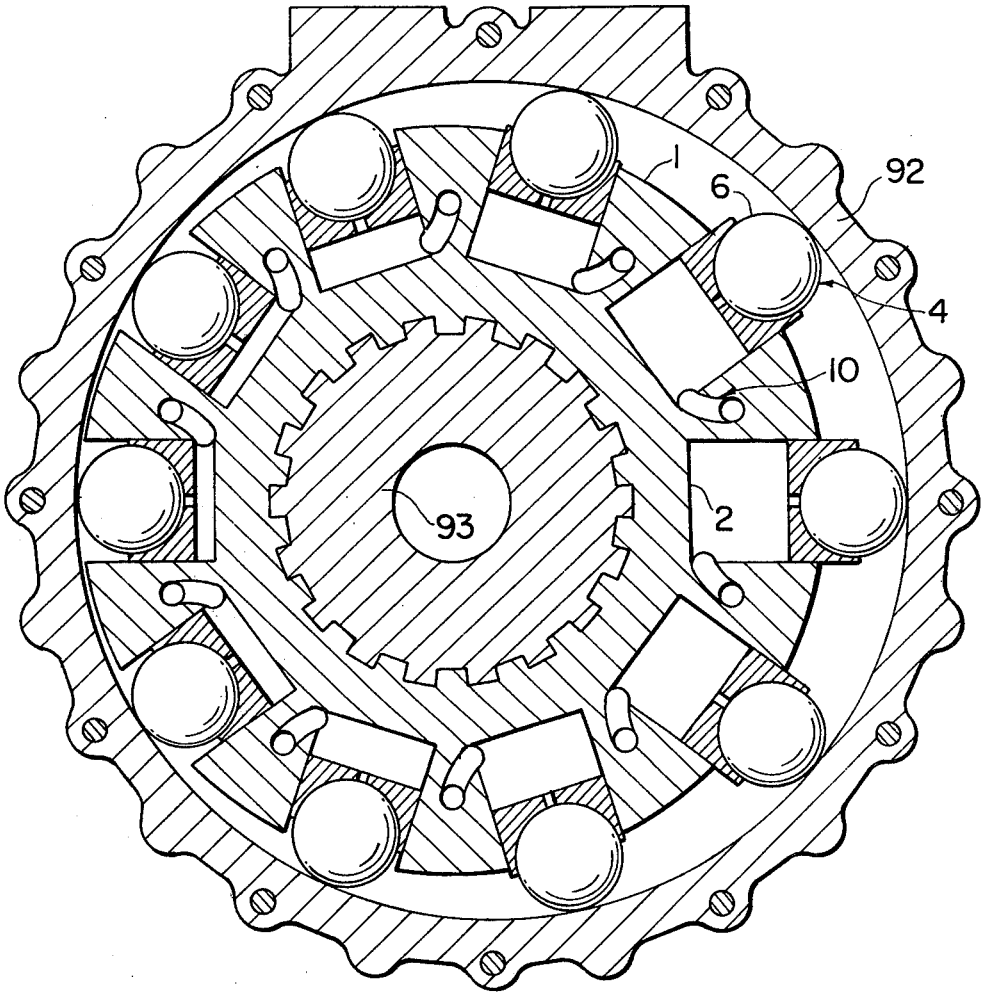
FIG. 11 is a cross-sectional view similar to FIG. 2 but showing a sixth embodiment of the radial piston type hydraulic pump-motor in which the ring casing has an inner face formed into a substantial circle and a shaft has a rotational axis eccentric relative to the axis of the inner face of the ring casing.

A fifth embodiment of the present invention is shown in FIG. 10, comprising a ring casing 91 with an inner face formed into a substantial ellipse, having such an axially cross-sectional curvature to be in contact with each of the spherical members 6 at its axially spaced two points, in place of the ring casing 16 consisting of the curved recesses 20 and the ridges 21 separated by the adjacent two curved recesses 20 in the first embodiment. A sixth embodiment of the present invention is shown in FIG. 11, comprising a ring casing 92 with an inner face formed into a substantial circle, having such an axially cross-sectional curvature to be in contact with each of the spherical members 6 at its axially spaced two points, in place of the ring casing 16 consisting of the curved recesses 20 and the ridges 21 separated by the adjacent two curved recesses 20 in the first embodiment and comprising a shaft 93 having a rotational axis eccentric relative to the axis of the inner face of the ring casing 92. The other constitutional elements of the fifth and sixth embodiments are substantially the same to those of the first embodiment so that there will not be described hereinafter about the other constitutional elements of the fifth and sixth embodiments for avoiding tedious repetition of the detailed description thereof.

According to the first embodiment of the present invention, the by-pass passages 42 and 43 are not necessarily needed resulting from the reason that the pressure oil is directly introduced into the reservoir recesses 40 and 41 so as to balance hydraulic pressures exerted upon the both side faces of the cylinder block 1 as well as to provide a liquid film between the opposing slide surfaces of the disc casings 14 and 14' and the cylinder block 1. Each of the piston assemblies 4 may include a piston radially slidably accommodated in each of the radial cylinders and formed at its radially outer end with a domed head contacting with the radially inner face of the ring casing 16 at its axially spaced two points. While it has been described in the first embodiment that the housing 13 comprises a pair of spaced and facing disc casings 14 and 14', a ring casing 16 interposed between the disc casings 14 and 14', and a pair of covers 18 and 18' respectively coupled with the axially outer faces of the disc casings 14 and 14', the housing in the present invention may include a pair of casings provided in symmetrical relation with a median plane and securely coupled by means of clamping members such as bolts and nuts circumferentially equally spaced. While it has been described in the first embodiment that the disc casings 14 and 14' are respectively formed therein that the main introducing passages 36 and 36', the branch introducing passages 37 and 37', the main discharge passages 38 and 38', and the branch discharge passages 39 and 39', either of the main introducing passage 36 or 36', the branch introducing passages 37 or 37', the main discharge passage 38 or 38', and the branch discharge passage 39 or 39' may be formed in the disc casing 14 or 14' according to the present invention. In this case, either of the central ring 27 or 27' suffices to be provided between the disc casing 14 or 14' and the shaft 22. According to the present invention, the disc casing 72 of the third embodiment may also be formed therein with additional branch introducing and discharge passages which are communicated with additional circumferential grooves, respectively, also formed in the inner peripheral wall of the disc casing 72, while the shaft 84 may also be formed therein with additional main introducing and discharge passages branchedly communicated with the additional circumferential grooves in a similar manner to the right half of FIG. 8. According to the present invention, one of the disc casings 72 and 72' may be formed therein with a main introducing passage and a plurality of branch introducing passages communicated with a circumferential groove formed in the inner peripheral wall thereof and the other of the disc casings 72 and 72' may be formed therein with a main discharge passage and a plurality of branch discharge passages communicated with a circumferential groove formed in the inner peripheral wall thereof.

Figure 16:
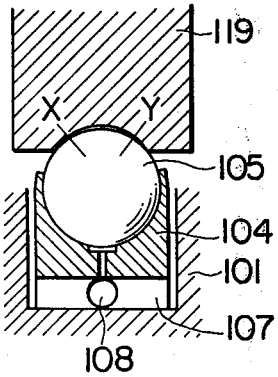
FIG. 16 is a cross-sectional view similar to FIG. 12 but showing a spherical member and a piston of the seventh embodiment of the radial piston type hydraulic pump-motor.
Figure 14:
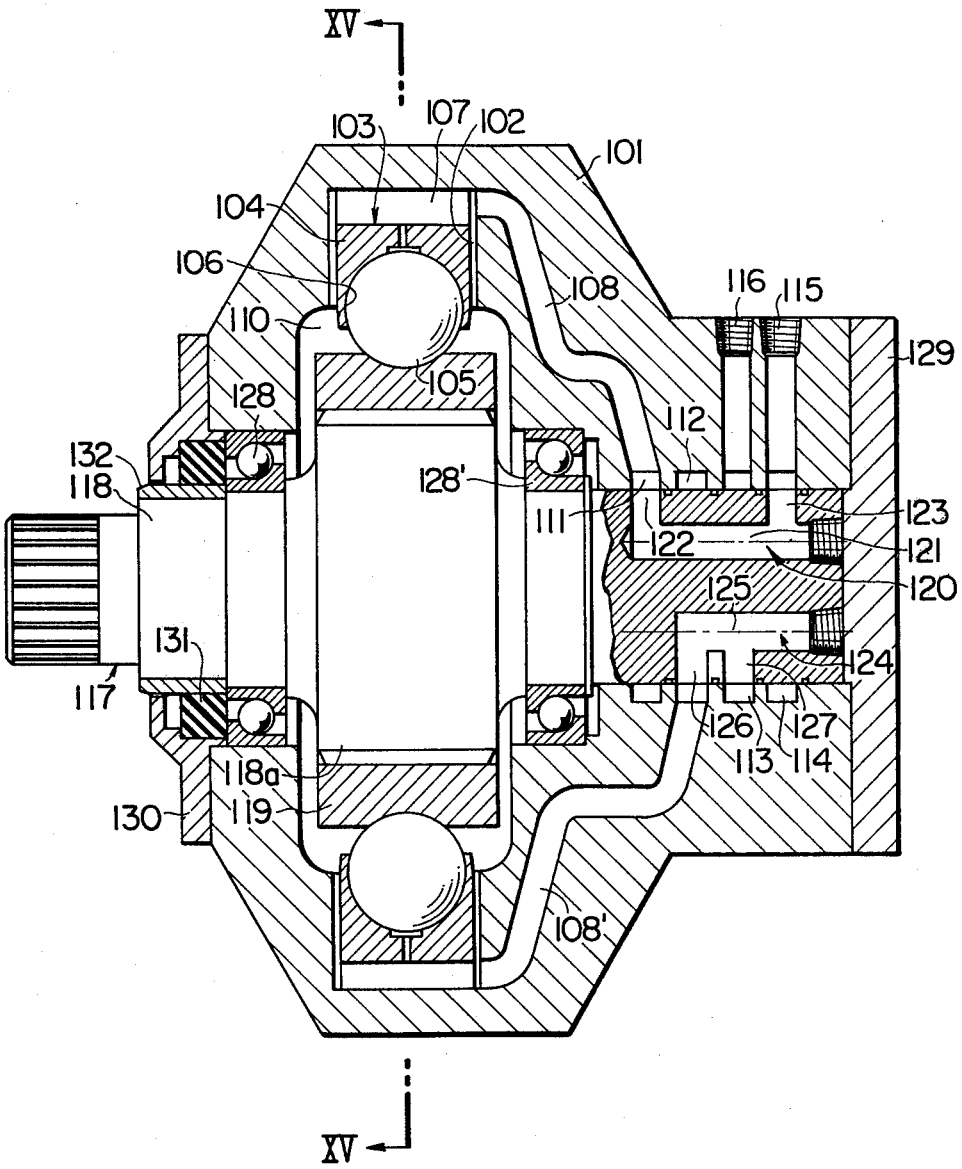
FIG. 14 is an axial cross-sectional view of a seventh embodiment of the radial piston type hydraulic pump-motor.
Figure 15:
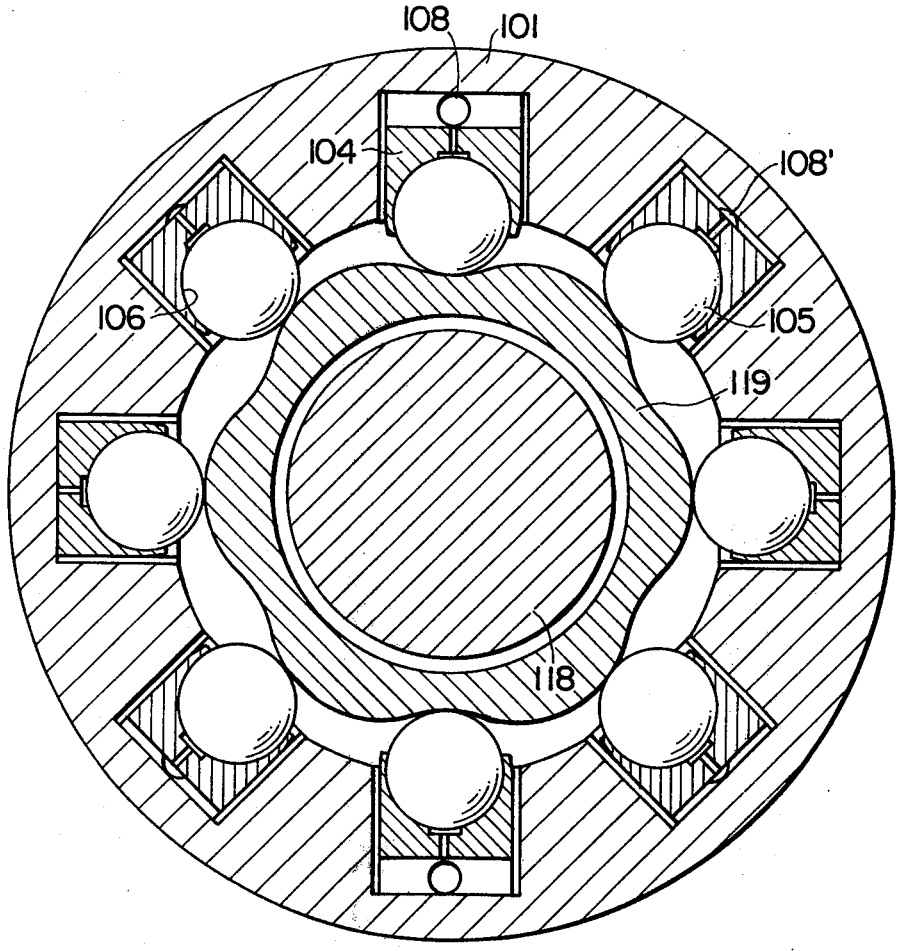
FIG. 15 is a cross-sectional view taken along the lines XV—XV of FIG. 14.

A seventh embodiment of the present invention is shown in FIGS. 14 and 15 as comprising a cylinder block 101 formed with a plurality of radial cylinders 102 which are circumferentially equally spaced and have radial opened inner ends. A plurality of piston assembly generally designated at 103 are shown as each comprising a piston 104 slidably accommodated in the radial cylinder 102 and a spherical member 105 rotatably retained on a curved recess 106 formed at the radially inner end of the piston 104 so that a cylinder chamber 107 is defined by the radial cylinder 102 and the piston 104. A plurality of pairs of inlet-outlet passages 108 and 108' are curvedly formed in the cylinder block 101 to have one ends opened at the radially inner wall of the radial cylinders 102. The cylinder block 101 is further formed with an axial bore 109 extending axially thereof and a cylinder block chamber 110 intermediately of and connected to the axial bore 109. On the fore portion of the axial bore 109 are formed first to fourth annular grooves 111 to 114 spaced axially, the first annular groove 111 being connected with the other ends of the inlet-outlet passages 108 while the second annular groove 112 being connected with the other ends of the inlet-outlet passages 108'. In the cylinder block 101 is formed introducing and discharge conduits 115 and 116, the former of which is connected at its one end to the fourth annular groove 114 and at its other end to a pressure oil source through a suitable pipe not shown and the latter of which is connected at its one end to the third annular groove 113 and at its other end to an oil tank through a suitable pipe also not shown. An axial assembly generally indicated at 117 comprises a shaft 118 formed with a flange portion **118*a* accommodated in the cylinder block chamber 110, and a cam member 119 splined to the outer periphery of the flange portion 118*a* and having a radially outer face in contact with the radially inner end of each of the spherical members 105 of the piston assemblies 103 at its axially spaced two points X and Y as shown in FIG. 16. An inlet conduit generally designated at 120 comprises an axial closed bore 121 formed in the fore portion of the shaft 118 and two radial bores 122 and 123 one of which has one end connected to the axial closed bore 121 and the other end communicated with the first annular groove 111, and the other of which has one end also connected to the axial closed bore 121 and the other end communicated with the fourth annular groove 114. An outlet conduit generally designated at 124 comprises an axial closed bore 125 formed in the fore portion of the shaft 118 and two radial bores 126 and 127 one of which has one end connected to the axial closed bore 125 and the other end communicated with the second annular groove 112, and the other of which has one end also connected to the axial closed bore 125 and the other end communicated with the third annular groove 113. A pair of bearings 128 and 128' are provided between the cylinder block 101 and the shaft 118 and at both sides of the flange portion 118*a* to impart relative rotational motion to the cylinder block 101 and the shaft 118. A fore cover 129 is bolted to the fore face of the cylinder block 101, and a rear cover 130 is similarly bolted to the rear face of the cylinder block 101. Between the shaft 118 and the rear cover 130 are an oil seal 131 and a cylindrical metal 132 which serve to seal oil in the cylinder block chamber 110**.

When the pressure oil is introduced into the introducing conduit 115 from the pressure oil source, the pressure oil reaches the one ends of the inlet-outlet passages 108 through the fourth annular groove 114, the inlet conduit 120, and the first annular groove 111. If the radially outer face of the piston 104 is at this time moved away from the bottom face of the radial cylinder 102 to open the one ends of the inlet-outlet passages 108, the pressure oil is entered into the cylinder chamber 107 to radially inwardly urge the piston assembly 103 against the cam member 119 so that the shaft 118 is caused to be rotated. On the other hand, the pressure oil which has actuated the piston assembly 103 is discharged to the oil tank through the inlet-outlet passages 108', the second annular groove 112, the outlet conduit 124, the third annular groove 113, and the discharge conduit 116.

Although the shaft 118 is rotated with the cylinder block 101 fixed in the above seventh embodiment of the present invention, the cylinder block 101 may be rotated with the shaft 118 fixed. In this case, the introducing and discharge conduits 115 and 116 are required to be closed by means of suitable plugs and the axial closed bores 121 and 125 of the inlet and outlet conduits 120 and 124 are also required to be opened to be in communication with the pressure oil source and the oil tank, respectively.

FIGS. 1 to 7, FIGS. 9 to 11 and FIGS. 14 to 16 show embodiments modifying a hydraulic motor and only FIG. 8 shows an embodiment modifying a hydraulic pump.

Although detailed descriptions have been made exclusively on the foregoing embodiments of this invention, it should be understood, as indicated hereinbefore, that the preferred embodiments as described and shown herein do not mean in any way limitations of this invention, but on the contrary, variations and modifications with respect to the construction and operation may further be derived by those skilled in the art to which the present invention pertains, whereby the advantageous characteristics of this invention may be realized without departing from the spirit and scope of the invention as set forth hereunto in the appended claims.

What is claimed is:

1. In a radial piston type hydraulic pump-motor, comprising:

a cylinder block formed with a plurality of radial cylinders circumferentially equally spaced and each opened at its radially outer end;

a plurality of piston assemblies each including a piston radially slidably accommodated in each of said radial cylinders and a spherical member rotatably retained on the radially outer end of said piston;

a plurality of inlet-outlet passages formed in said cylinder block, each having one end opened at said cylinder chamber and the other end opened exteriorly of said cylinder block;

a housing including a pair of spaced and facing disc casings, and a ring casing interposed between and fixed to said disc casings to define a chamber for accommodating said cylinder block, said ring casing having an inner face formed with a multiplicity of curved recesses and a multiplicity of ridges each separated by said adjacent two curved recesses, said curved recesses and ridges being symmetrical with respect to a central plane passing through the centers of said spherical members and perpendicular to the axis of said cylinder block, the improvement characterized in that:

said spherical member of each of said piston assemblies is in contact with said curved recesses and ridges at its axially spaced two points symmetrically with respect to said central plane.

2. A radial piston type hydraulic pump-motor as defined in claim 1, which further comprises:

a plurality of reservoir recesses formed in said housing with one of adjacent two reservoir recesses in opposing relation with each of the other ends of said branch introducing passages and with remaining one of adjacent two reservoir recesses in opposing relation with each of the other ends of said branch discharge passages;

a plurality of by-pass passages formed in said housing with one of adjacent two by-pass passages having one end communicated with said introducing passage and the other end opened at said reservoir recess opposing to each of the other ends of said branch introducing passages and with remaining one of adjacent two by-pass passages having one end opened at said discharge passage and the other end opened at said reservoir recess opposing to each of the other ends of said branch discharge passages, whereby hydraulic pressures horizontally exerted upon the both side faces of said cylinder block are maintained balanced and a liquid film is provided between the opposing slide surfaces of said housing and said cylinder block.

3. A radial piston type hydraulic pump-motor as defined in claim 1, wherein:

each of said inlet-outlet passages includes a horizontal bore horizontally extending throughout and opened at the side faces of said cylinder block and a cylinder bore having one end opened at said cylinder chamber and the other end communicated with the longitudinally intermediate portion of said horizontal bore, said horizontal bore being provided radially outwardly of said cylinder bore.

* * * * *